US012025325B2

(12) United States Patent
Oikawa

(10) Patent No.: US 12,025,325 B2
(45) Date of Patent: Jul. 2, 2024

(54) OUTDOOR UNIT FOR AIR-CONDITIONING APPARATUS AND METHOD FOR ASSEMBLING OUTDOOR UNIT FOR AIR-CONDITIONING APPARATUS

(71) Applicant: Mitsubishi Electric Corporation, Tokyo (JP)

(72) Inventor: Kyonosuke Oikawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 269 days.

(21) Appl. No.: 17/637,215

(22) PCT Filed: Nov. 6, 2019

(86) PCT No.: PCT/JP2019/043429
§ 371 (c)(1),
(2) Date: Feb. 22, 2022

(87) PCT Pub. No.: WO2021/090391
PCT Pub. Date: May 14, 2021

(65) Prior Publication Data

US 2022/0299214 A1 Sep. 22, 2022

(51) Int. Cl.
*F24F 1/46* (2011.01)
*F24F 1/56* (2011.01)

(52) U.S. Cl.
CPC . *F24F 1/46* (2013.01); *F24F 1/56* (2013.01)

(58) Field of Classification Search
CPC ..... F24F 1/46; F24F 1/40
See application file for complete search history.

(56) References Cited

U.S. PATENT DOCUMENTS

2020/0200404 A1 6/2020 Kawaguchi

FOREIGN PATENT DOCUMENTS

| | | | | |
|---|---|---|---|---|
| CN | 207865564 U | 9/2018 | | |
| CN | 208846576 U | 5/2019 | | |
| EP | 2042820 A2 * | 4/2009 | ..... | F24F 1/10 |
| EP | 2042820 A2 | 4/2009 | | |

(Continued)

OTHER PUBLICATIONS

Office Action dated Aug. 31, 2023 issued in the corresponding Chinese Patent Application No. 201980101432.2 (and English machine translation).

(Continued)

*Primary Examiner* — Lionel Nouketcha
(74) *Attorney, Agent, or Firm* — Posz Law Group, PLC

(57) ABSTRACT

Provided are an outdoor unit for an air-conditioning apparatus and a method for assembling such an outdoor unit for an air-conditioning apparatus. Such an outdoor unit has a structure in which an oil separator is fixed to a partition plate with an auxiliary component. An outdoor unit for an air-conditioning apparatus includes a fan chamber, a machine chamber accommodating a compressor and an oil separator, and a partition plate partitioning off the fan chamber and the machine chamber. The oil separator is fixed to the partition plate with an auxiliary component. The auxiliary component includes a leg portion fixed to the partition plate, and a bed portion attached to the leg portion such that the bed portion is detachable, the bed portion supporting the oil separator.

9 Claims, 12 Drawing Sheets

(56) References Cited

FOREIGN PATENT DOCUMENTS

| | | | |
|---|---|---|---|
| JP | 2005-076924 | A | 3/2005 |
| JP | 2008-267651 | A | 11/2008 |
| JP | 2009-085465 | A | 4/2009 |
| JP | 2011-112324 | A | 6/2011 |
| JP | 2013-194960 | A | 9/2013 |
| JP | 2019-163878 | A | 9/2019 |
| WO | 2017/042950 | A1 | 3/2017 |
| WO | 2019/097614 | A1 | 5/2019 |

OTHER PUBLICATIONS

Office Action dated Feb. 28, 2023 issued in corresponding CN Patent Application No. 201980101432.2 (and English machine translation).
Office Action dated Dec. 23, 2022 issued in corresponding DE Patent Application No. 112019007872.0 (and English translation).
Office Action dated Jan. 17, 2023 issued in corresponding JP Patent Application No. 2021-554459 (and English machine translation).
International Search Report dated Dec. 24, 2019, issued in corresponding International Patent Application No. PCT/JP2019/043429 (and English machine translation).
Decision of Rejection dated Feb. 27, 2024 issued in corresponding CN Patent Application No. 201980101432.2 (and English machine translation).

* cited by examiner

OUTDOOR UNIT FOR AIR-CONDITIONING APPARATUS AND METHOD FOR ASSEMBLING OUTDOOR UNIT FOR AIR-CONDITIONING APPARATUS

CROSS REFERENCE TO RELATED APPLICATION

This application is a U.S. National Stage Application of International Application No. PCT/JP2019/043429, filed on Nov. 6, 2019, the contents of which are incorporated herein by reference.

TECHNICAL FIELD

The present disclosure relates to an outdoor unit for an air-conditioning apparatus and a method for assembling such an outdoor unit for an air-conditioning apparatus. Such an outdoor unit has a structure in which an oil separator is fixed to a partition plate with an auxiliary component.

BACKGROUND ART

The inside of an outdoor unit for an air-conditioning apparatus is partitioned into a fan chamber and a machine chamber with a partition plate. The fan chamber contains a fan and a heat exchanger. The machine chamber contains electronic components and a pipe assembly. A component that is referred to as an accumulator and that is configured to store refrigerant is connected to the pipe assembly in the machine chamber. In some types of outdoor units, an accumulator is disposed above a compressor to reduce the size of a machine chamber. In an outdoor unit having such a configuration, an accumulator is fixed to a partition plate above a compressor.

Patent Literature 1 proposes directly attaching an accumulator to a reinforcing plate fitted to a partition plate. Attaching the reinforcing plate to the partition plate increases the rigidity of the partition plate. As a result, the partition plate has a sufficient rigidity to support the weight of the accumulator, and vibrations propagating from the accumulator to the partition plate are reduced.

CITATION LIST

Patent Literature

Patent Literature 1: Japanese Unexamined Patent Application Publication No. 2009-085465

SUMMARY OF INVENTION

Technical Problem

In such a structure in Patent Literature 1 in which an accumulator is fixed to a partition plate, the accumulator having a great weight has to be fixed to a reinforcing plate. Thus, ease of assembling other components is reduced. Similarly to the accumulator, when an oil separator assembly formed by an oil separator and pipes connected to the oil separator is attached to a partition plate by use of a reinforcing plate as in Patent Literature 1 to achieve a sufficient rigidity of the partition plate, the oil separator assembly has to be fixed to the reinforcing plate fixed to the partition plate. Thus, there arises a problem of reducing ease of assembly.

The present disclosure is made to solve such a problem and to obtain an outdoor unit for an air-conditioning apparatus capable of improving ease of attaching an oil separator to a partition plate, and a method for assembling such an outdoor unit for an air-conditioning apparatus.

Solution to Problem

An outdoor unit for an air-conditioning apparatus according to an embodiment of the present disclosure includes a fan chamber, a machine chamber accommodating a compressor and an oil separator, and a partition plate partitioning off the fan chamber and the machine chamber. The oil separator is fixed to the partition plate with an auxiliary component. The auxiliary component includes a leg portion fixed to the partition plate, and a bed portion attached to the leg portion such that the bed portion is detachable, the bed portion supporting the oil separator.

Advantageous Effects of Invention

The outdoor unit for an air-conditioning apparatus according to an embodiment of the present disclosure is capable of improving ease of attaching the oil separator to the partition plate.

DESCRIPTION OF EMBODIMENTS

Figure 1:
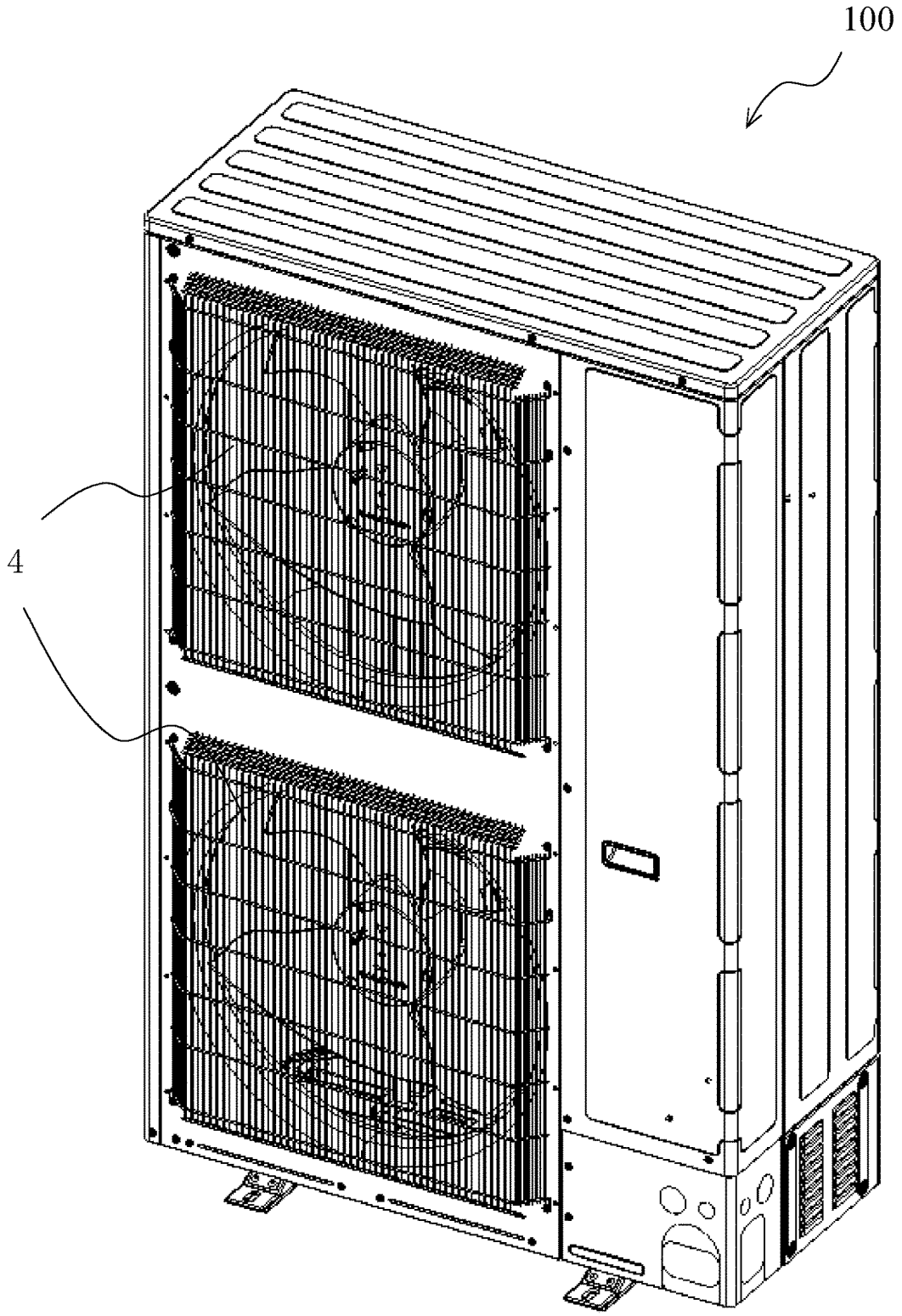
FIG. 1 is an external perspective view of an outdoor unit for an air-conditioning apparatus according to Embodiment.
Figure 2:
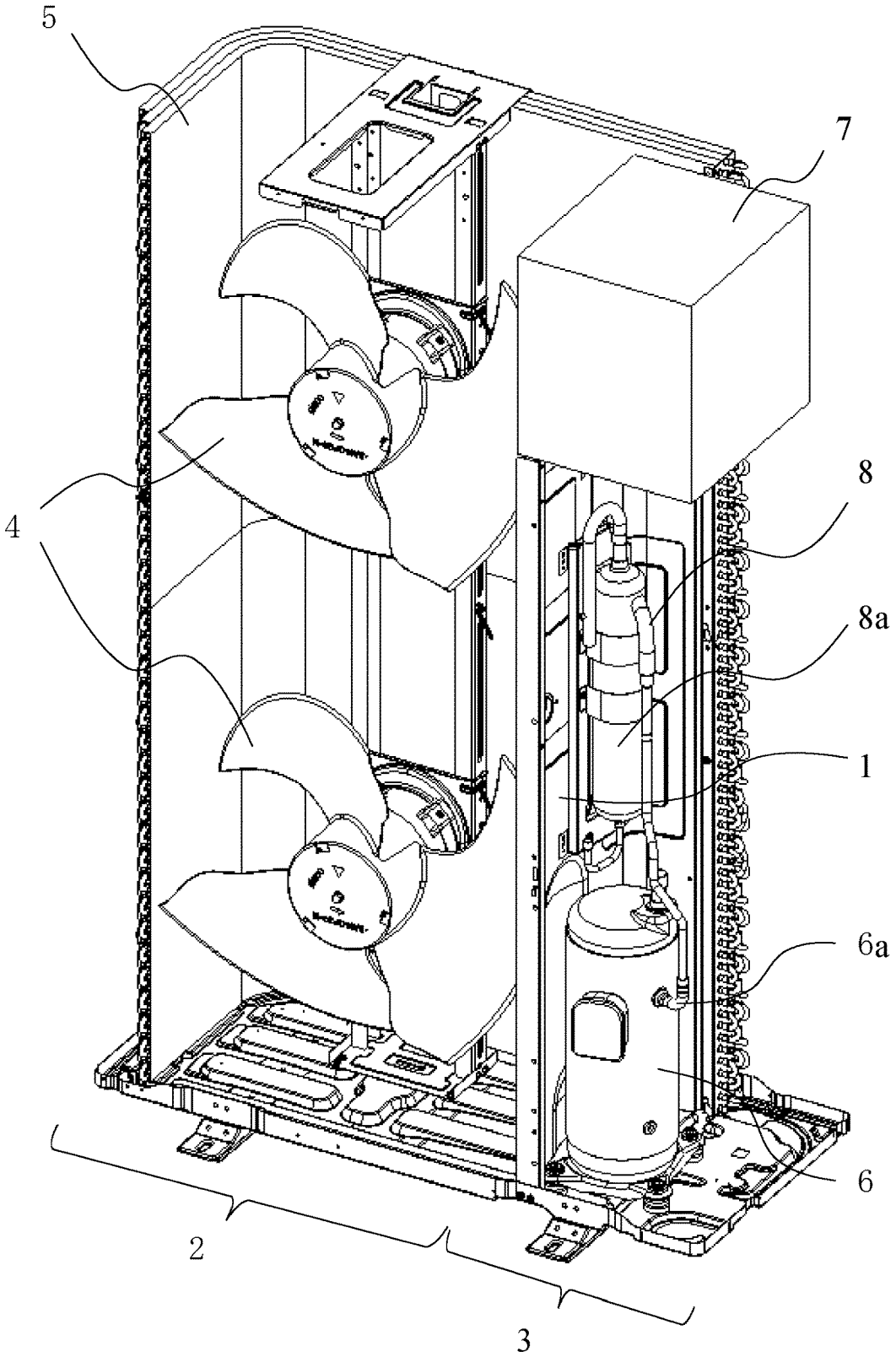
FIG. 2 is an internal perspective view of the outdoor unit for an air-conditioning apparatus according to Embodiment.

FIG. 1 is an external perspective view of an outdoor unit 100 for an air-conditioning apparatus according to Embodiment. FIG. 2 is an internal perspective view of the outdoor unit 100 for an air-conditioning apparatus according to Embodiment. As illustrated in FIG. 1, for example, the outdoor unit 100 for an air-conditioning apparatus includes two fans 4, which are provided to be arranged in an up-down direction. As illustrated in FIG. 2, the inside of the outdoor unit 100 for an air-conditioning apparatus is partitioned into a fan chamber 2 and a machine chamber 3 with a partition plate 1. The fans 4 and a heat exchanger 5 are disposed in the fan chamber 2. A compressor 6, an electrical component box 7, and an oil separator assembly 8 are disposed in the machine chamber 3.

The oil separator assembly 8 is formed by connecting a plurality of pipes to an oil separator 8*a*. The oil separator 8*a* has a cylindrical shape and is configured to separate oil from gas refrigerant discharged from the compressor 6. The oil separator assembly 8 is disposed above the compressor 6 and is connected to a discharge pipe 6*a* of the compressor 6.

Figure 3:
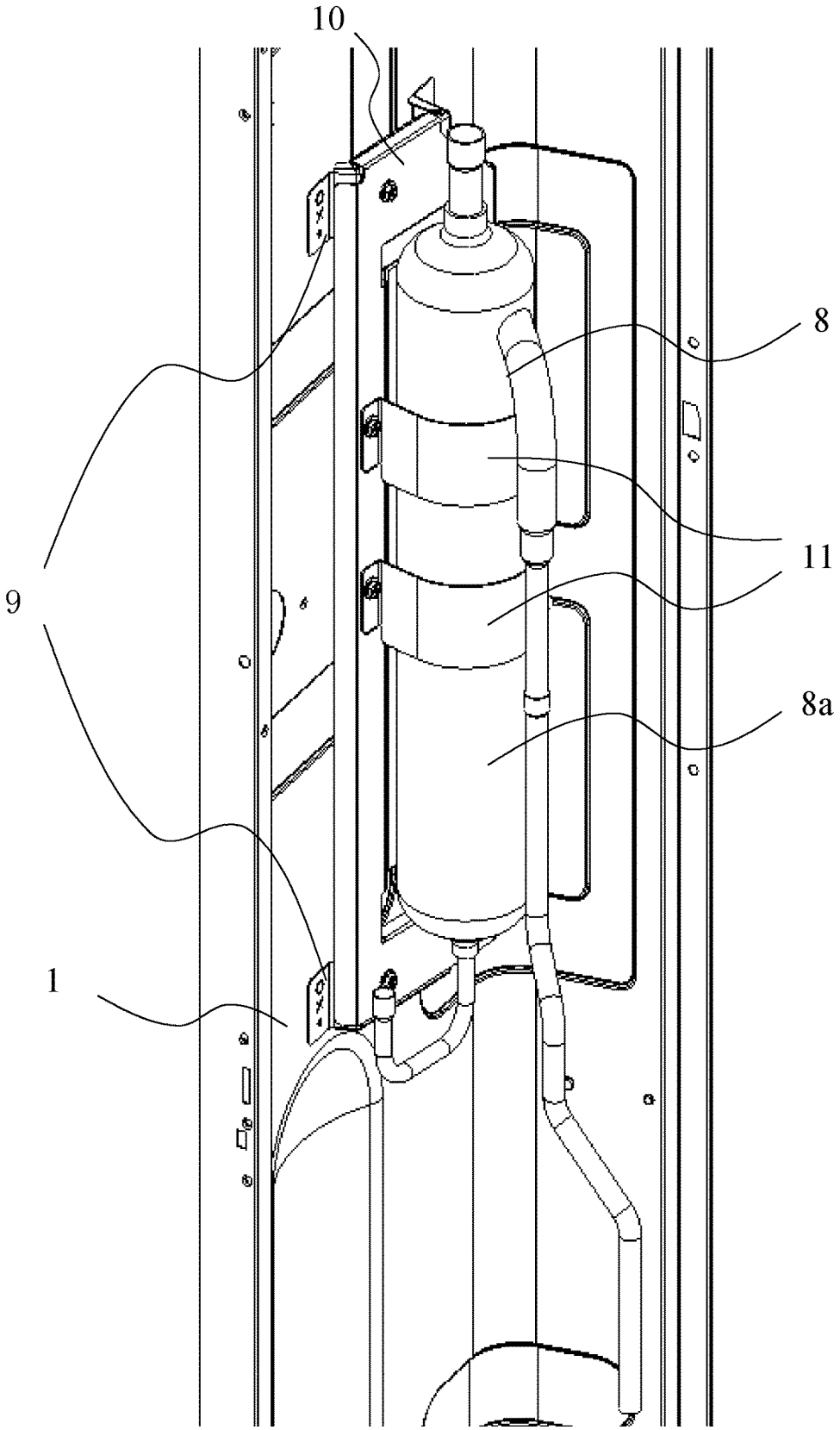
FIG. 3 is a perspective view of an oil separator assembly according to Embodiment attached to a partition plate.

FIG. 3 is a perspective view of the oil separator assembly 8 according to Embodiment attached to the partition plate 1. As illustrated in FIG. 3, the oil separator assembly 8 is attached to the partition plate 1 with an auxiliary component formed by leg portions 9, a bed portion 10, and band portions 11.

Specifically, the bed portion 10 is fixed to the leg portions 9 fixed to the partition plate 1, and the oil separator assembly 8 is supported by the bed portion 10. Thus, the oil separator assembly 8 is attached to the partition plate 1. In addition, the oil separator assembly 8 is fixed to the bed portion 10 with the band portions 11.

Figure 4:
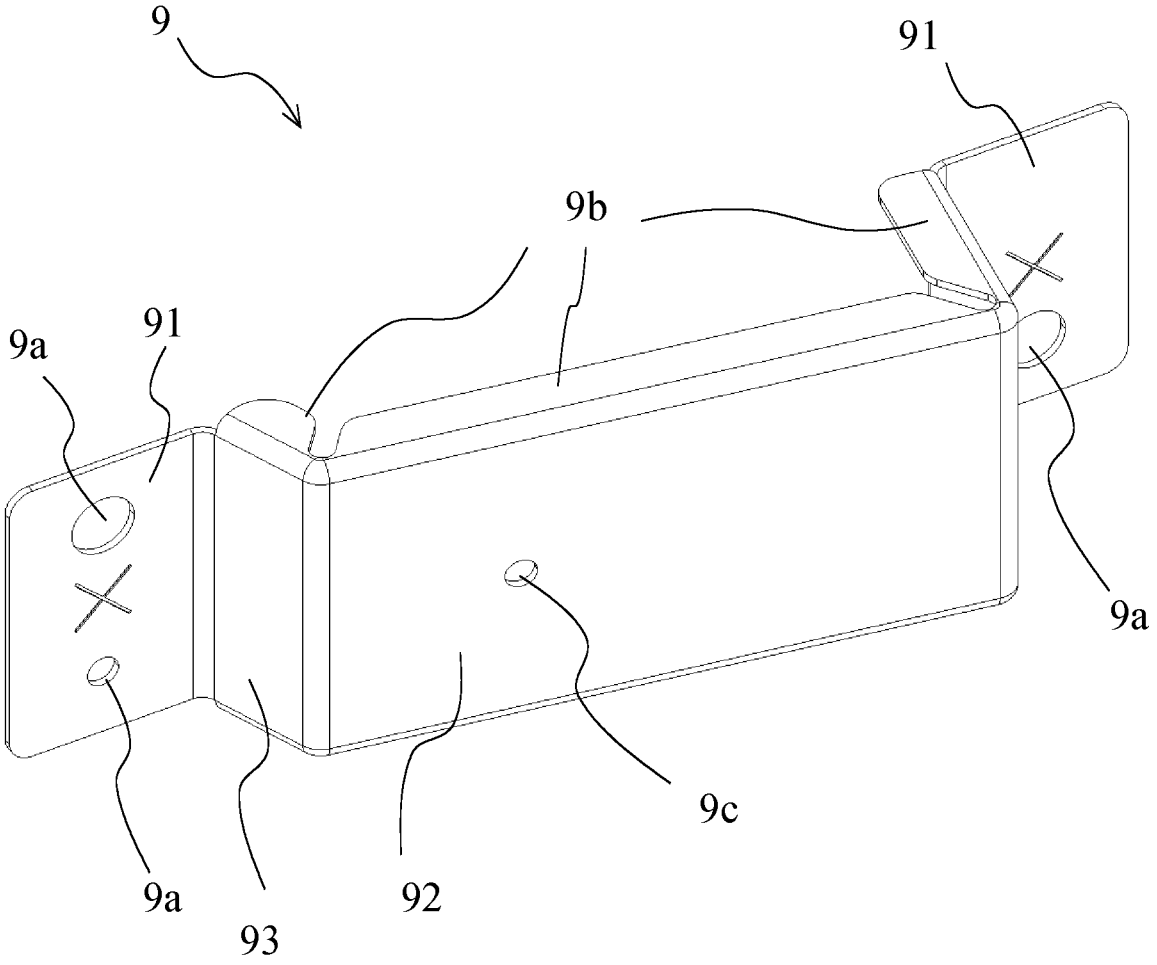
FIG. 4 is a detailed diagram of a leg portion according to Embodiment.
Figure 5:
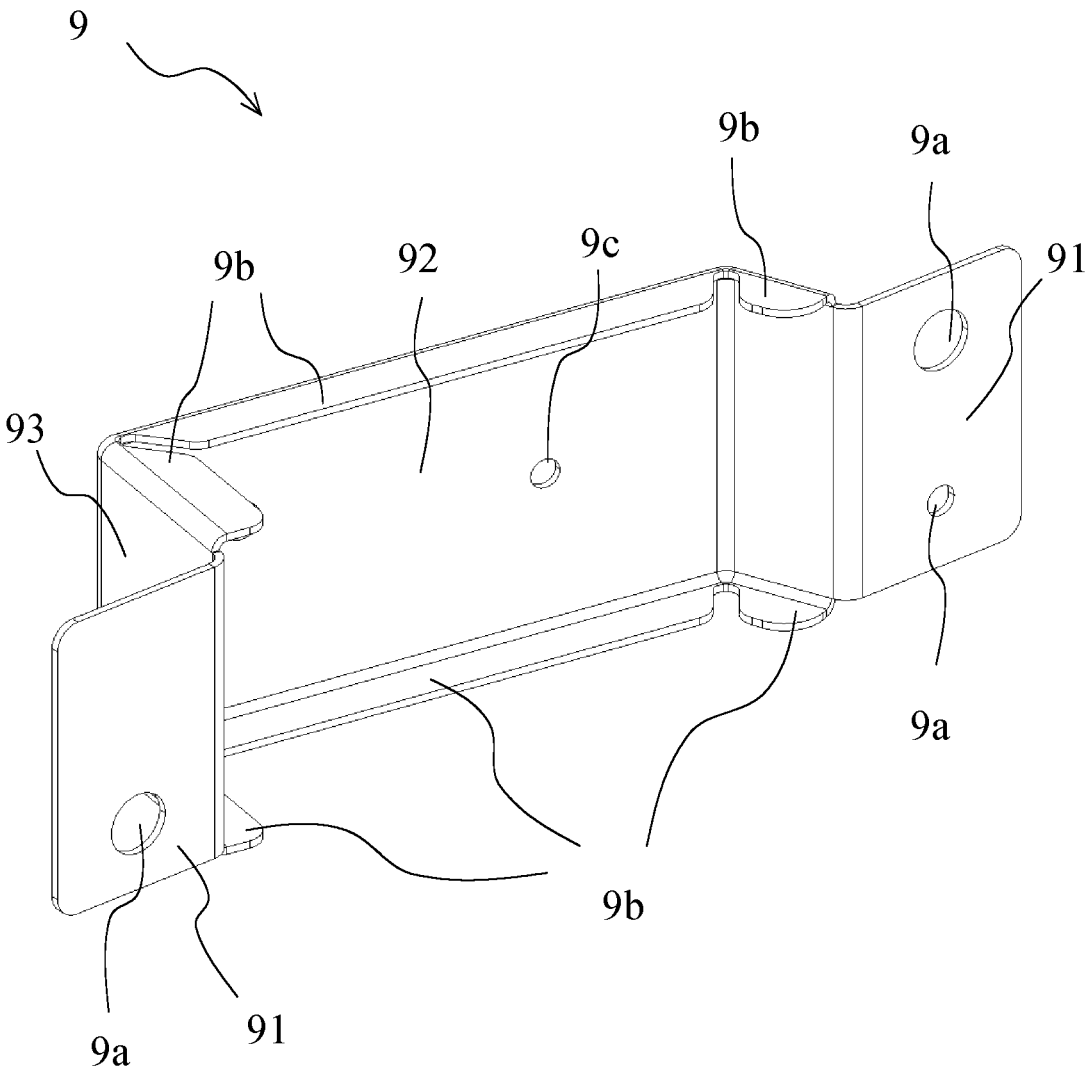
FIG. 5 is a detailed diagram of the leg portion according to Embodiment when viewed from the side opposite from the side in FIG. 4.

FIG. 4 is a detailed diagram of the leg portion 9 according to Embodiment. FIG. 5 is a detailed diagram of the leg portion 9 according to Embodiment when viewed from the side opposite from the side in FIG. 4. As illustrated in FIGS. 4 and 5, the leg portion 9 is formed by flat portions 91, which are located at respective opposite ends of the leg portion 9 in a long-side direction of the leg portion 9, a central portion 92, which is located between the two flat portions 91, and bridge portions 93, each of which bridges the central portion 92 and the corresponding flat portion 91. Each of the bridge portions 93 extends in a direction crossing the flat portions 91 and the central portion 92 and bridges the corresponding flat portion 91 and the central portion 92 such that the flat portions 91 and the central portion 92 extend parallel to each other to form a step shape.

The flat portions 91 located at the respective opposite ends have a total of three positioning holes 9*a*. The positioning holes 9*a* are provided to perform positioning of the leg portion 9 to be attached to the partition plate 1. For example, one positioning hole 9*a* is provided in one of the flat portions 91 located at the respective opposite ends, and two positioning holes 9*a* are provided in the other of the flat portions 91 located at the respective opposite ends. For example, the two positioning holes 9*a* provided in the other of the flat portions 91 are formed to have different sizes. The three positioning holes 9*a* provided in the flat portions 91 located at the respective opposite ends clarify the position of the leg portion 9 in the up-down direction and in a left-right direction and facilitate the positions of the flat portions 91 located at the respective opposite ends in a height direction of the leg portion 9 to maintain horizontally.

The central portion 92 and the bridge portions 93 of the leg portion 9 each include leg portion flanges 9*b*, which are formed by bending an upper edge and a lower edge of each of the central portion 92 and the bridge portions 93. The rigidity of the leg portion 9 is increased by forming the leg portion flanges 9*b* extending in respective directions crossing flat surfaces of the central portion 92 and the bridge portions 93.

The central portion 92 of the leg portion 9 has a screw hole 9*c*. The screw hole 9*c* is a hole into which a screw for fixing the bed portion 10 to the leg portion 9 is inserted.

Figure 6:
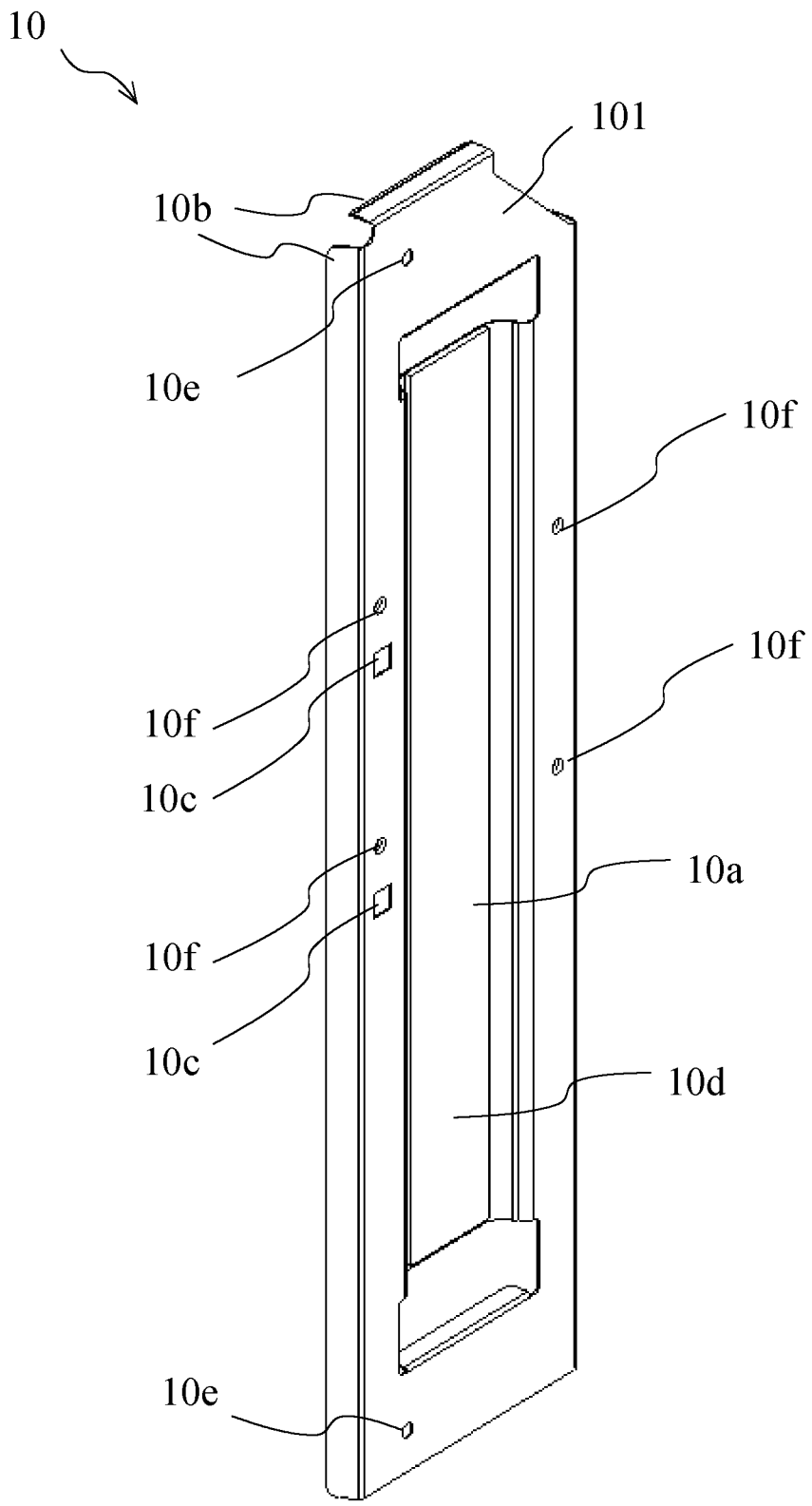
FIG. 6 is a detailed diagram of a bed portion according to Embodiment.
Figure 7:
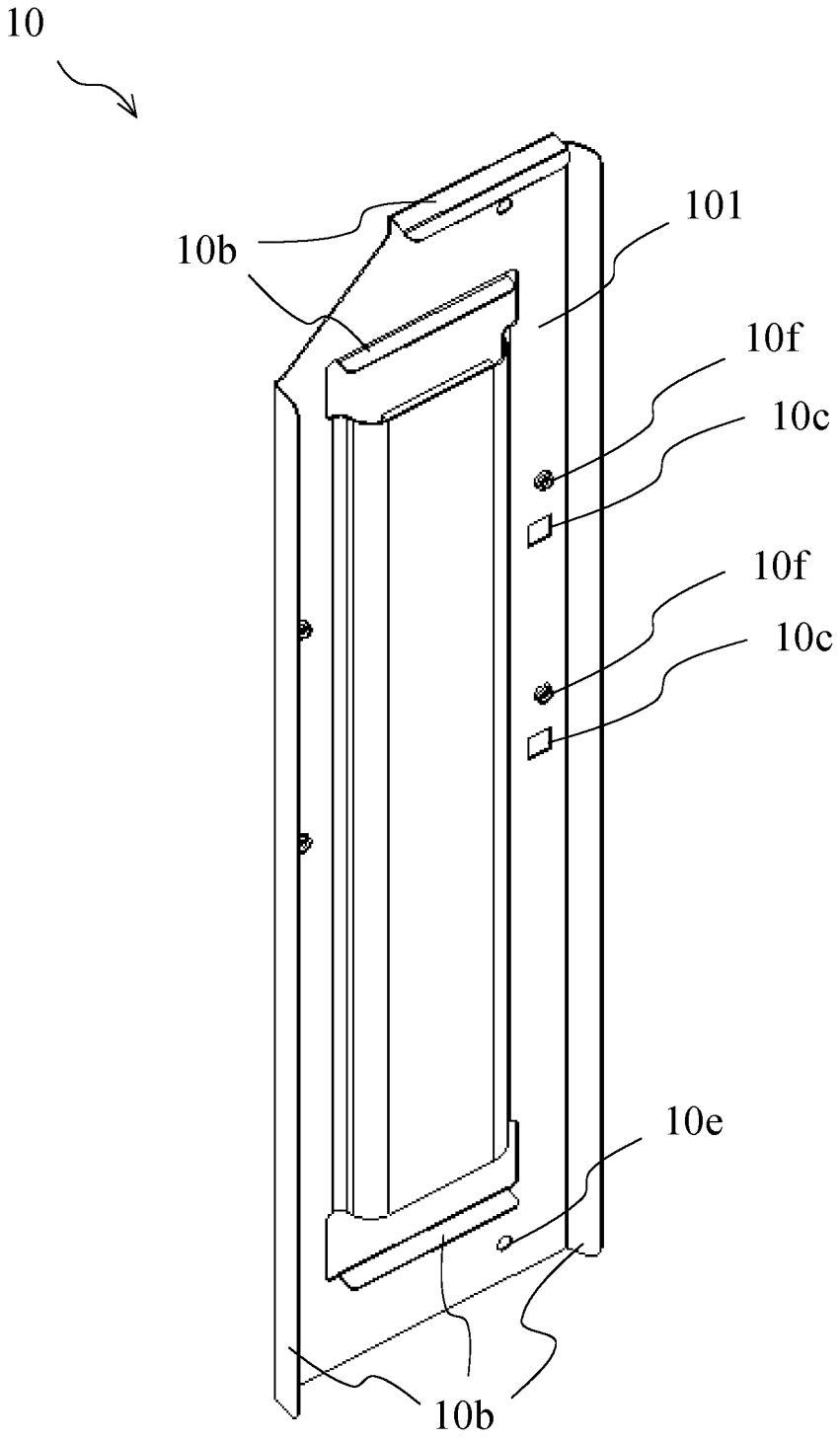
FIG. 7 is a detailed diagram of the bed portion according to Embodiment when viewed from the side opposite from the side in FIG. 6.

FIG. 6 is a detailed diagram of the bed portion 10 according to Embodiment. FIG. 7 is a detailed diagram of the bed portion 10 according to Embodiment when viewed from the side opposite from the side in FIG. 6. As illustrated in FIGS. 6 and 7, the bed portion 10 includes a recessed portion 10*a*, which is formed at the center of the bed portion 10. A flat surface is provided around the periphery of the recessed portion 10*a* The flat region around the periphery of the recessed portion 10*a* is referred to as a peripheral portion 101.

The parts of the peripheral portion 101 extending in a short-side direction of the bed portion 10 each have a screw hole 10*e*, The bed portion 10 is attached such that the bed portion 10 is detachable, with a screw to be inserted into the screw hole 10*e* of the bed portion 10, to each leg portion 9 with the peripheral portion 101 having a flat shape being in contact with the central portion 92 of the leg portion 9.

The bed portion 10 includes bed portion flanges 10*b*, which extend from respective edges of the peripheral portion 101 in a direction crossing the peripheral portion 101. For example, the bed portion flanges 10*b* are each formed by bending the corresponding edge portion of the peripheral portion 101. For example, the bed portion flange 10*b* is formed by a part provided to project from the bed portion 10. The bed portion flange 10*b* of the bed portion 10 is provided to hook the bed portion flange 10*b* on the leg portion flange 9*b* of the leg portion 9 when the bed portion 10 is attached to the leg portion 9. Thus, the bed portion flange 10*b* has a shape along the shape of the leg portion flange 9*b* of the leg portion 9. The provision of the bed portion flanges 10*b* at the bed portion 10 facilitates attaching the bed portion 10 to the leg portions 9.

The recessed portion 10*a* of the bed portion 10 has an outline extending in a long-side direction of the bed portion 10 and is recessed in the same direction as a direction in which the bed portion flanges 10*b* extend. The oil separator 8*a* of the oil separator assembly 8 is fitted into the recessed portion 10*a*. As a result, the oil separator assembly 8 is supported by the bed portion 10.

A cushioning material 10*d* is stuck on an inner surface of the recessed portion 10*a*, For example, a sponge is usable as the cushioning material 10*d*. The provision of the cushioning material 10*d* on the recessed portion 10*a*, which serves as a contact surface where the bed portion 10 and the oil separator 8*a* are in contact with each other, enables a reduction in the space between the bed portion 10 and the oil separator 8*a*. Thus, for example, positional deviation of the oil separator assembly 8 and the bed portion 10 due to vibrations is unlikely to occur.

The peripheral portion 101 of the bed portion 10 has screw holes 10*f* and rectangular holes 10*c*, which are arranged in the long-side direction of the bed portion 10. The rectangular holes 10*c* of the bed portion 10 are provided to perform positioning of the band portions 11 to be attached to the bed portion 10. The screw holes 10*f* of the bed portion 10 are provided to fix the band portions 11 to the bed portion 10.

Figure 8:
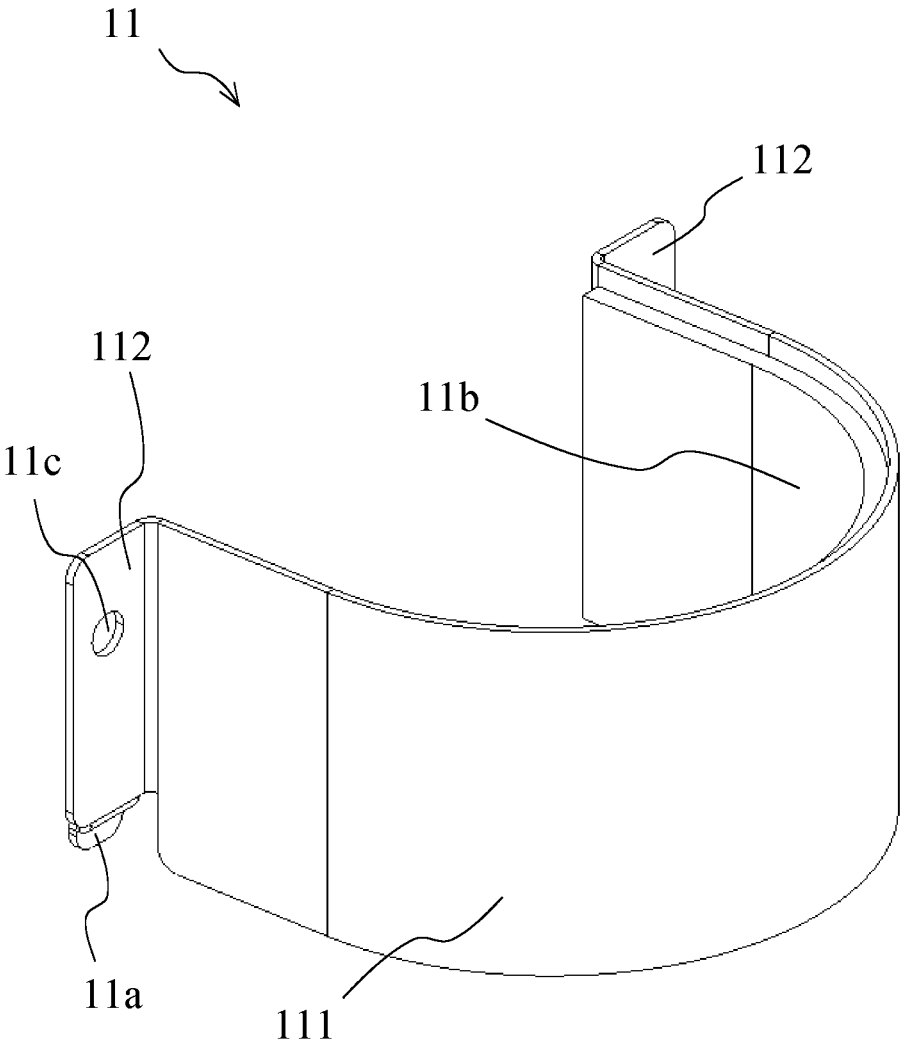
FIG. 8 is a detailed diagram of a band portion according to Embodiment.
Figure 9:
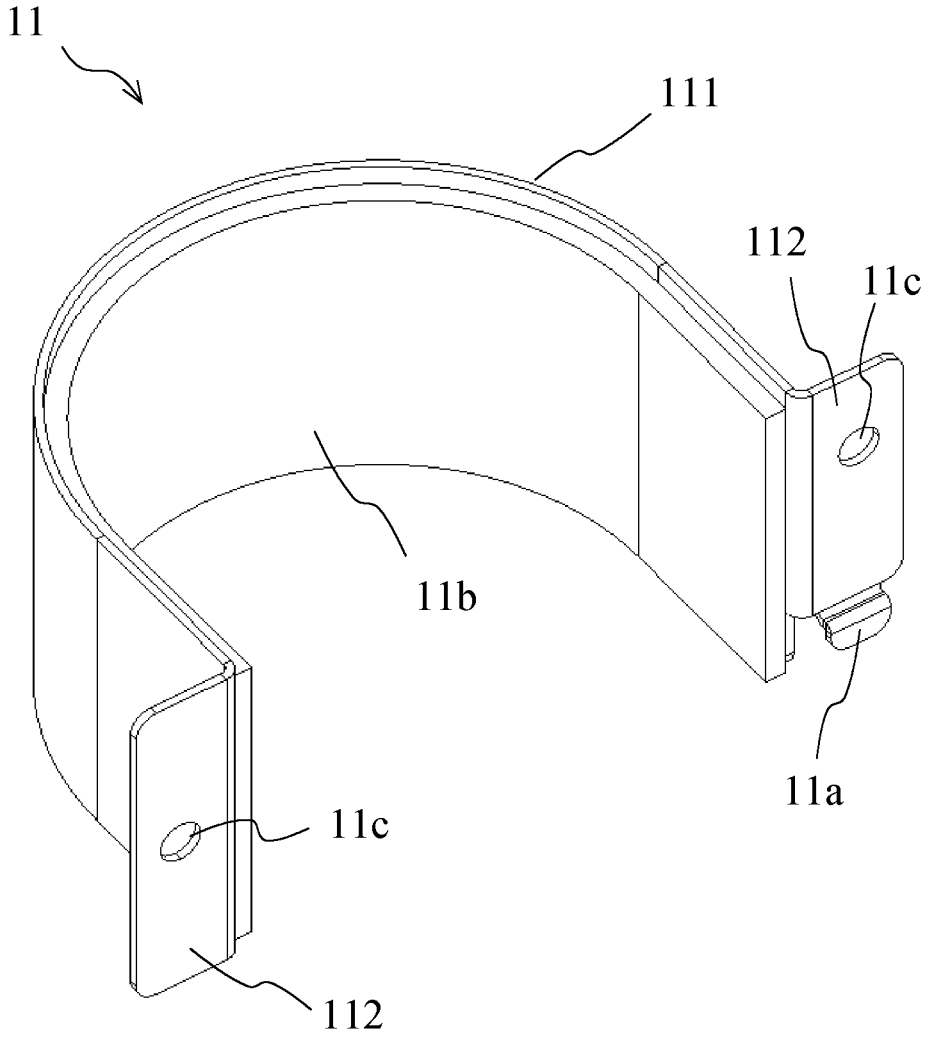
FIG. 9 is a detailed diagram of the band portion according to Embodiment when viewed from the side opposite from the side in FIG. 8.

FIG. 8 is a detailed diagram of the band portion 11 according to Embodiment. FIG. 9 is a detailed diagram of the band portion 11 according to Embodiment when viewed from the side opposite from the side in FIG. 8. As illustrated in FIGS. 8 and 9, the band portion 11 is formed by a curved portion 111, which is located at the center of the band portion 11, and flat portions 112, which are located at respective opposite sides of the curved portion 111.

The curved portion 111 has a curved shape along a peripheral surface of the oil separator 8*a*. A cushioning material 11*b* is stuck on the inside of the curved portion 111. The curved portion 111 of the band portion 11 serves as a contact surface to be in contact with the oil separator 8*a*. Thus, the provision of the cushioning material 11*b* on the curved portion 111 enables a reduction in the space between the band portion 11 and the oil separator 8*a*. Accordingly, the oil separator 8*a* is firmly held by the band portion 11, resulting in a propagating vibration reduction and an abnormal noise reduction.

One of the flat portions 112 located at the respective opposite sides of the curved portion 111 has a claw portion 11*a*, which projects downward from the lower end of the one of the flat portions 112. Positioning of the band portion 11 and the bed portion 10 is performed by inserting the claw portion 11*a* into the rectangular hole 10*c* of the bed portion 10.

Each of the flat portions 112 located at the respective opposite sides of the curved portion 111 has a screw hole 11*c*, The band portion 11 is fixed to the bed portion 10 by inserting a screw into each screw hole 11*c* of the band portion 11 and the corresponding screw hole 10*e* of the bed portion 10 and by fixing the screw to the holes.

Next, a method for assembling the outdoor unit 100 for an air-conditioning apparatus according to Embodiment will be described.

Figure 10:
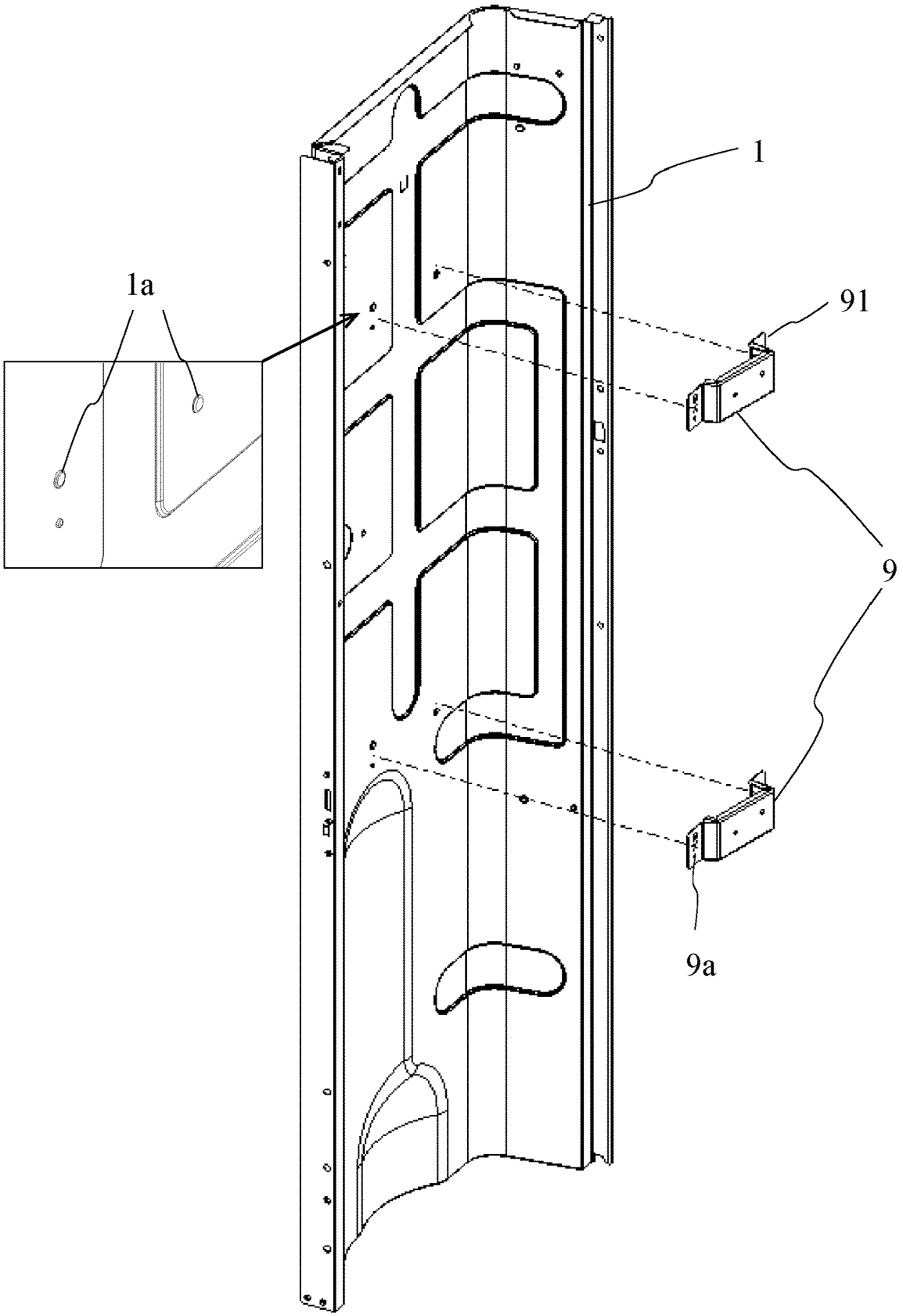
FIG. 10 is a perspective view illustrating a step of fixing the leg portions according to Embodiment to the partition plate.

FIG. 10 is a perspective view illustrating a step of fixing the leg portions 9 according to Embodiment to the partition plate 1. As illustrated in FIG. 10, in the step of fixing the leg portions 9 to the partition plate 1, the leg portions 9 are each disposed such that the long-side direction of the leg portion 9 extends in a width direction of the partition plate 1. Then, positioning of the partition plate 1 and the leg portions 9 is performed such that the positioning holes 9*a* of the leg portions 9 are fitted to respective embossed portions 1*a*, which are formed on the partition plate 1. Then, the flat portions 91 located at the respective opposite ends of each leg portion 9 are fixed to the partition plate 1 by spot welding with the flat portions 91 in contact with the partition plate 1. As a result, the leg portions 9 are fixed to the partition plate 1.

The embossed portions 1*a* each have a shape in which part of the partition plate 1 projects in a direction from the fan chamber 2 toward the machine chamber 3. For example, the embossed portion 1*a* is formed by embossing. The leg portions 9 are attached to two respective parts of the partition plate 1 arranged in the up-down direction. The leg portions 9 may be provided on two or more parts of the partition plate 1 arranged in the up-down direction. It is preferable to set the number of the leg portions 9 to be two or more because this enables the leg portions 9 to share a load and thus enables the load on each leg portion 9 to be reduced. In addition, the three positioning holes 9*a* provided in the leg portion 9 enable positioning of the leg portion 9 to be attached to the partition plate 1 in the up-down direction and the left-right direction to be more accurate.

Figure 11:
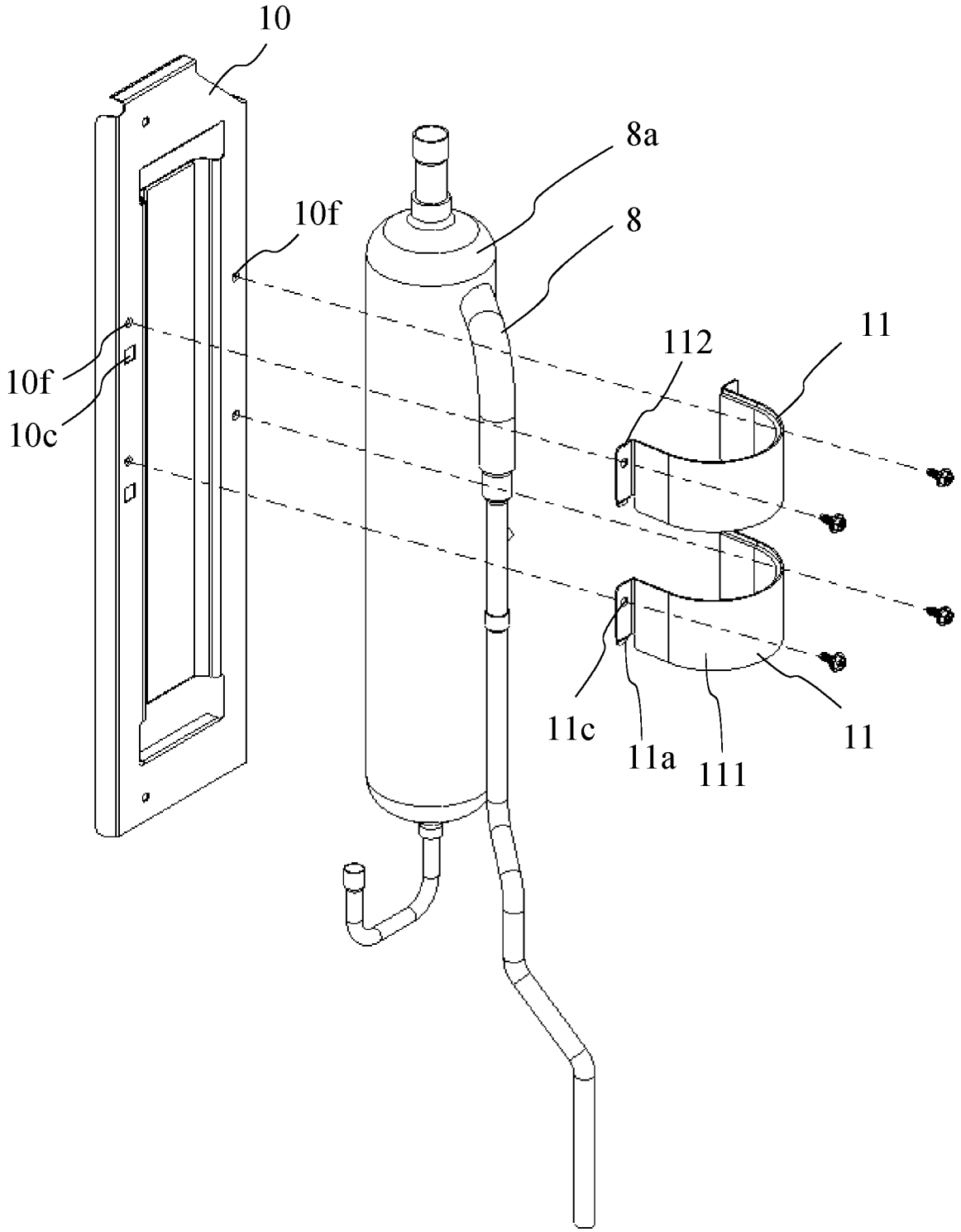
FIG. 11 is a perspective view illustrating a step of fixing the oil separator assembly, the bed portion, and the band portions according to Embodiment.

FIG. 11 is a perspective view illustrating a step of fixing the oil separator assembly 8, the bed portion 10, and the band portions 11 according to Embodiment. In the step of fixing the oil separator assembly 8, the bed portion 10, and the band portions 11, first, the oil separator 8*a* is fitted to and placed on the recessed portion 10*a* of the bed portion 10.

Subsequently, the oil separator assembly 8 is fixed to the bed portion 10 with the band portions 11. Specifically, the curved portions 111 of the band portions 11 are disposed on and along the peripheral surface of the oil separator 8*a*, and the flat portions 112 of the band portions 11 are disposed on and along the peripheral portion 101 of the bed portion 10. Then, positioning of the band portions 11 is performed by inserting each claw portion 11*a* of the band portions 11 into the corresponding rectangular hole 10*c* of the bed portion 10. Then, a screw is inserted into each screw hole 11*c* of the band portions 11 and the corresponding screw hole 10*e* of the bed portion 10 and is fixed to the holes with the flat portions 112 of the band portions 11 being in contact with the peripheral portion 101 of the bed portion 10.

As a result, the oil separator assembly 8 is fixed to the bed portion 10 with the band portions 11. Similarly to the leg portions 9, the band portions 11 are attached to two respective parts of the oil separator 8*a* arranged in the up-down direction but may be provided on two or more parts of the oil separator 8*a* arranged in the up-down direction. It is preferable to set the number of the band portions 11 to be two or more because this enables the oil separator 8*a* to be more firmly fixed.

Figure 12:
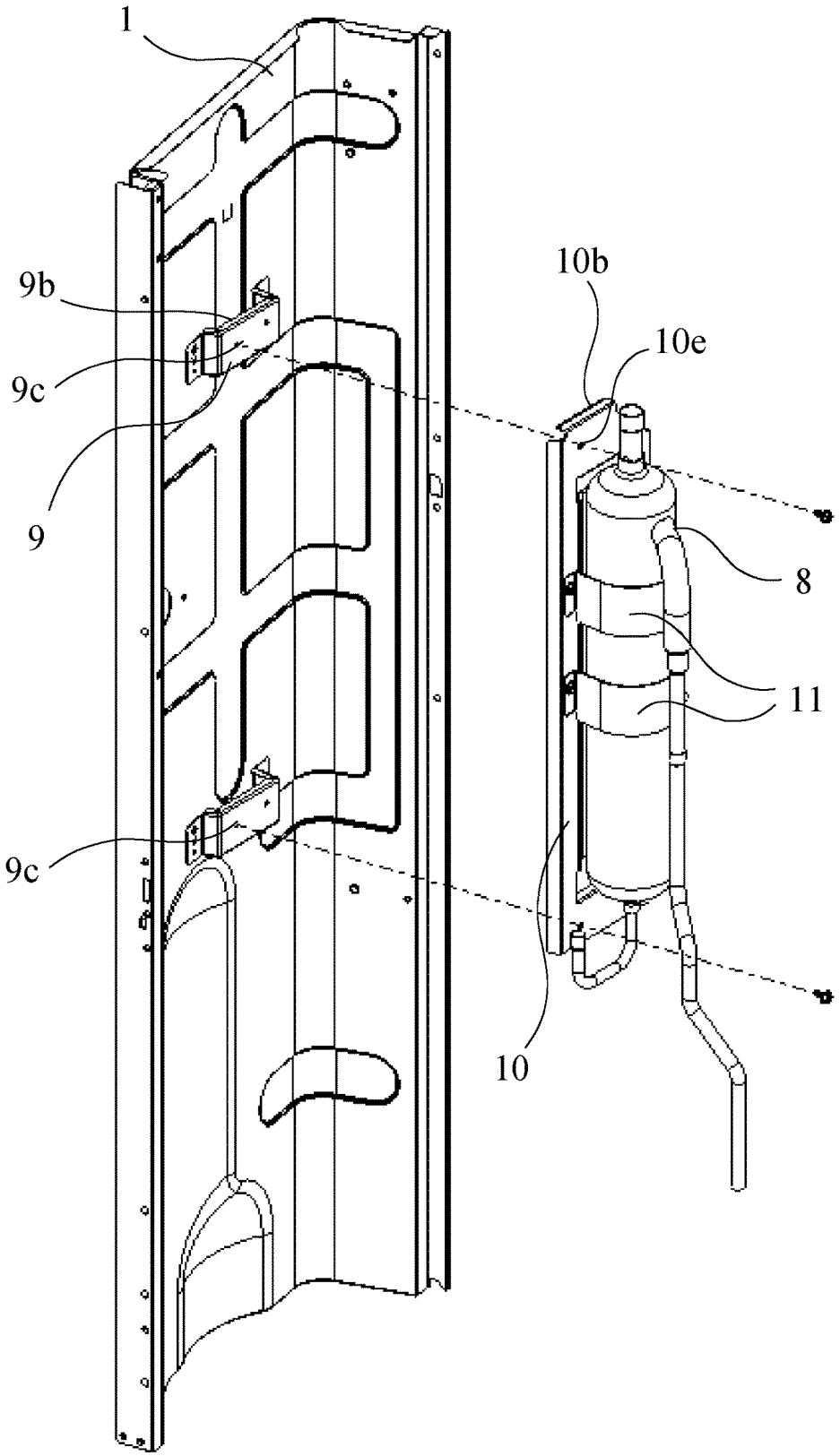
FIG. 12 is a perspective view illustrating a step of attaching the oil separator assembly according to Embodiment to the partition plate.

FIG. 12 is a perspective view illustrating a step of attaching the oil separator assembly 8 according to Embodiment to the partition plate 1. As illustrated in FIG. 12, in the step of attaching the oil separator assembly 8 to the partition plate 1, bed portion flanges 10*b* of the bed portion 10 to which the oil separator assembly 8 is fixed with the band portions 11 are hooked on the corresponding leg portion flanges 9*b* of the leg portion 9 fixed to the partition plate 1. Then, a screw is inserted into each screw hole 10*e* of the bed portion 10 and the corresponding screw hole 9*c* of the leg portions 9 and is fixed to the holes. As a result, the oil separator assembly 8 is attached to the partition plate 1.

After the oil separator assembly 8 is attached to the partition plate 1, pipes of the oil separator assembly 8 and the discharge pipe 6*a* of the compressor 6 are connected to each other. Then, assembly of the outdoor unit 100 for an air-conditioning apparatus is completed.

In the outdoor unit 100 for an air-conditioning apparatus according to Embodiment described above, the oil separator assembly 8 is fixed to the partition plate 1 with the auxiliary component including the leg portions 9 fixed to the partition plate 1, and the bed portion 10 on which the oil separator assembly 8 is placed. Thus, even when the weight of the oil separator assembly 8 is increased, the partition plate 1 has a sufficient rigidity as the partition plate 1 is reinforced with the auxiliary component. In addition, the leg portions 9, fixed to the partition plate 1, of the auxiliary component and the bed portion 10 on which the oil separator assembly 8 is placed are attachable and detachable. This facilitates attaching the oil separator assembly 8 to the partition plate 1. Furthermore, when an operator connects the compressor 6 to the oil separator assembly 8, the operator does not have to support the oil separator assembly 8 by fixing the oil separator assembly 8 to the partition plate 1, resulting in the connecting operation being easy. Furthermore, the outdoor unit 100 has the configuration in which the leg portions 9 and the bed portion 10 of the auxiliary component are interposed between the oil separator assembly 8 and the partition plate 1. Thus, vibrations propagating to the partition plate 1 are reduced compared with those in a case in which the oil separator assembly 8 is directly fixed to the partition plate 1. This reduces vibrations of the pipes connected to the oil separator assembly 8 generated by propagating pipe vibrations generated during operation of the outdoor unit 100 to the oil separator assembly 8.

Furthermore, the oil separator assembly 8 and the bed portion 10 are united by the band portions 11. This facilitates attaching the oil separator assembly 8 to the partition plate 1.

Furthermore, the provision of the embossed portions 1*a* on the partition plate 1 facilitates positioning of the leg portions 9 and the partition plate 1.

Furthermore, the leg portion flanges 9*b* of the leg portions 9 and the bed portion flanges 10*b* of the bed portion 10 enable an increase in the rigidity of the leg portions 9 and the bed portion 10 and facilitate positioning of the leg portions 9 and the bed portion 10 and fixing the leg portions 9 and the bed portion 10 to each other.

Furthermore, the leg portions 9 to which the oil separator assembly 8 is not attached are easy to handle and are thus easily attached to the partition plate 1. The partition plate 1 and the leg portions 9 are securely fixed to each other by spot welding. On the other hand, the bed portion 10 is fixed to the leg portions 9 with screws. This facilitates attaching the oil separator assembly 8 to the partition plate 1.

Furthermore, the provision of the cushioning material 10*d* on the bed portion 10 enables a reduction in the space between the bed portion 10 and the oil separator assembly 8. Thus, positional deviation of the bed portion 10 and the oil separator assembly 8 due to, for example, vibrations is unlikely to occur. In addition, it is possible to reduce noise. Similarly, the provision of the cushioning material 11*b* on the band portion 11 enables a reduction in the space between the band portion 11 and the oil separator assembly 8. Accordingly, it is possible to reduce noise.

Furthermore, the oil separator 8*a* is fitted into the recessed portion 10*a* of the bed portion 10. This stabilizes the position of the oil separator 8*a* placed on the bed portion 10.

REFERENCE SIGNS LIST

1: partition plate, 1*a*: embossed portion, 2: fan chamber, 3: machine chamber, 4: fan, 5: heat exchanger, 6: compressor, 6*a*: discharge pipe, 7: electrical component box, 8: oil separator assembly, 8*a*: oil separator, 9: leg portion, 9*a*: positioning hole, 9*b*: leg portion flange, 9*c*: screw hole, 10: bed portion, 10*a*: recessed portion, 10*b*: bed portion flange, 10*c*: rectangular hole, 10*d*: cushioning material, 10*e*: screw hole, 10*f*: screw hole, 11: band portion, 11*a*: claw portion, 11*b*: cushioning material, 11*c*: screw hole, 91: flat portion, 92: central portion, 93: bridge portion, 100: outdoor unit, 101: periphery, 111: curved portion, 112: flat portion

The invention claimed is:

1. An outdoor unit for an air-conditioning apparatus, the outdoor unit comprising:

a fan chamber;

a machine chamber accommodating a compressor and an oil separator; and a partition plate partitioning off the fan chamber and the machine chamber, the oil separator being fixed to the partition plate with an auxiliary component, the auxiliary component including a leg portion fixed to the partition plate, and a bed portion attached to the leg portion such that the bed portion is detachable from the leg portion, the bed portion supporting the oil separator, the bed portion including a recessed portion having an outline extending in a long-side direction of the bed portion, the oil separator being fitted into the recessed portion such that a long-side direction of the oil separator extends in the same direction as the long-side direction of the bed portion.

2. The outdoor unit for an air-conditioning apparatus of claim 1, wherein the auxiliary component further includes a band portion with which the oil separator is fixed to the bed portion.

3. The outdoor unit for an air-conditioning apparatus of claim 2, wherein the bed portion and the band portion are fixed to each other with a screw.

4. The outdoor unit for an air-conditioning apparatus of claim 1, wherein the leg portion has a positioning hole, the partition plate has an embossed portion, and the embossed portion is fitted into the positioning hole.

5. The outdoor unit for an air-conditioning apparatus of claim 1, wherein the leg portion includes a leg portion flange, the bed portion includes a bed portion flange, and the leg portion and the bed portion are fixed to each other by hooking the bed portion flange on the leg portion flange.

6. The outdoor unit for an air-conditioning apparatus of claim 1, wherein the leg portion is fixed to the partition plate by spot welding, and the leg portion and the bed portion are fixed to each other with a screw.

7. The outdoor unit for an air-conditioning apparatus of claim 1, wherein a cushioning material is provided on a contact surface where the auxiliary component and the oil separator are in contact with each other.

8. The outdoor unit for an air-conditioning apparatus of claim 1, wherein a flat surface is provided around a periphery of the recessed portion.

9. A method for assembling an outdoor unit for an air-conditioning apparatus, the method comprising:

fixing a leg portion included in an auxiliary component to a part of a partition plate partitioning off a fan chamber and a machine chamber, the part of the partition plate facing the machine chamber;

fitting an oil separator to a bed portion including a recessed portion having an outline extending in a long-side direction such that a long-side direction of the oil separator extends in the same direction as the long-side direction of the bed portion;

fixing the oil separator fitted to the bed portion with a band portion included in the auxiliary component;

fixing, to the leg portion, the bed portion to which the oil separator is fitted, the bed portion being included in the auxiliary component; and connecting, to the oil separator, a discharge pipe of a compressor accommodated in the machine chamber.

* * * * *